United States Patent [19]

Leyh

[11] 4,248,674

[45] Feb. 3, 1981

[54] ANODIZING METHOD AND APPARATUS

[76] Inventor: Henry W. Leyh, P.O. Box 617, Gulf Shores, Ala. 36542

[21] Appl. No.: 76,981

[22] Filed: Sep. 20, 1979

[51] Int. Cl.[3] ..... C25D 11/04; C25D 17/10

[52] U.S. Cl. ..... 204/28; 204/211

[58] Field of Search ..... 204/17, 28, 211, 206

[56] References Cited

U.S. PATENT DOCUMENTS

| | | | |
|---|---|---|---|
| 2,275,194 | 3/1942 | Sizelove | 204/284 |
| 2,494,954 | 1/1950 | Mason | 204/28 |
| 2,538,317 | 1/1951 | Mason | 204/28 |
| 2,541,275 | 2/1951 | Odier | 204/211 |
| 2,743,229 | 4/1956 | Hill | 204/290 |
| 2,901,412 | 8/1959 | Mostovych | 204/211 |
| 3,038,850 | 6/1962 | Wagner | 204/206 |
| 3,079,308 | 2/1963 | Ramirez | 204/28 |
| 3,352,769 | 11/1967 | Ruben | 204/143 |
| 3,359,189 | 12/1967 | Cooke | 204/28 |
| 3,359,190 | 12/1967 | Cooke | 204/28 |
| 3,471,375 | 10/1969 | Cooke | 204/28 |
| 3,535,222 | 10/1970 | Cooke | 204/207 |
| 3,563,863 | 2/1971 | Vierow | 204/28 |
| 3,726,781 | 4/1973 | Verneuil | 204/286 |
| 3,920,524 | 11/1975 | Rogers | 204/28 |
| 3,920,525 | 11/1975 | Fromson | 204/28 |
| 4,177,127 | 12/1979 | Laubenfeld | 204/206 |

FOREIGN PATENT DOCUMENTS

| | | | |
|---|---|---|---|
| 467024 | 6/1937 | United Kingdom | 204/211 |

*Primary Examiner*—T. M. Tufariello

*Attorney, Agent, or Firm*—Jones, Thomas & Askew

[57] ABSTRACT

A system for anodizing aluminum wherein an aluminum web is positively charged predominantly on a first surface thereof, subsequently immersed in an electrolyte having a cathode therein, and thereafter a current is passed through the electrolyte between the cathode and a second surface of the aluminum opposite to the first surface. The foregoing is accomplished by an apparatus having an anode in a contact cell disposed parallel to the first surface of the aluminum web and cathodes in an anodizing cell disposed predominantly adjacent the second surface of the aluminum web. The anodized coating deposited on the second surface of the web is sealed by a cold water spray.

8 Claims, 5 Drawing Figures

CLEANING TANK
DESMUT TANK
RINSE SPRAY
CONTACT CELL
ANODIZING CELL
COLD WATER SPRAY

ANODIZING METHOD AND APPARATUS

FIELD OF THE INVENTION

The present invention relates to the anodization of metal, and more particularly relates to the production of anodized aluminum lithographic plates.

BACKGROUND ART

Several techniques for anodizing aluminum have been developed in the prior art and have consisted generally of placing a positive charge on a continuous aluminum web that is then passed through an anodizing cell for electrolytically depositing an aluminum oxide coating on the surface of the aluminum web. In an early prior art technique, the positive charge was placed on the aluminum web by passing a web over a conductive contact roller, such as is shown in U.S. Pat. No. 3,563,863 and U.S. Pat. No. 2,538,317. A significant problem with the contact roll method has been arcing between the roll and the aluminum web which causes pitting of the aluminum and deterioration of the contact roll.

Another known technique for introducing a positive charge on the aluminum web includes passing the web through a contact cell containing anodes and an electrolyte which electrically connects the annodes to the web, such as is shown in U.S. Pat. No. 3,920,525. A major problem with the contact cell method is that "burning" occurs in the anodizing cell caused by the surge of the current into the web as it enters the anodizing cell. It will be seen that a need to prevent arcing in the contact roller technique and a need to prevent burning in the contact cell technique have limited the maximum current densities that can be applied in the anodization process and therefore have limited the production rates that can be obtained.

In prior art systems using the contact cell technique, the configuration of electrodes has typically been one wherein either all the anodes in the contact cell and all the cathodes in the anodizing cell have been on the same side of the web or both the anodes and the cathodes have been evenly distributed on both sides of the web in both cells. Also, it is generally accepted in the anodization art that the anodized coating on the web should be sealed with hot water at a temperature, for example, of 200° F., as taught in U.S. Pat. No. 2,538,317.

SUMMARY OF THE INVENTION

The present invention provides a thicker, more evenly distributed anodized coating on one side of a metal web than has been possible in the prior art without increasing the current density applied. The improved plate of the present invention is produced using a novel arrangement of anodes in a contact cell and cathodes in an anodizing cell and therefore does not present any increased risk of burning of the anodized web that would accompany an increase in the current density.

Generally described, the present invention comprises, in an apparatus for anodizing a metal web, including a contact cell containing an electrolyte and an anodizing cell containing the electrolyte, the improvement comprising: an anode mounted within the contact cell so as to extend parallel to the path of the web and adjacent to a first side of the web, and a cathode mounted within the anodizing cell, adjacent a second side of the web opposite to the first side of the web. The anode is preferably a perforated aluminum plate shaped in the form of a "V" paralleling a V-shaped path of the web through the contact cell, and is preferably coated with chemical lead. Another novel feature of the present invention is that the anodized coating is sealed by a cold water spray rather than by hot water as taught by the prior art.

Generally described, the method of the invention comprises the steps of placing a positive charge predominantly on a first surface of a metal plate, subsequently immersing the plate in an electrolyte having a cathode therein, and passing a current through the electrolyte between the cathode and a second surface of the plate opposite to the first surface thereof.

It is believed that the advantageous arrangement of electrodes in the contact and anodizing cells creates a differential positive charge on the first side of the web which causes deep penetration of the oxides which are deposited on the opposite side of the web by the current flowing from the cathode located on the opposite side of the web. In prior art arrangements of the anodes and cathodes, no differential distribution of positive charge on opposite sides of the web would be expected, and therefore there would be no positive charge positioned so as to draw the negatively charged ions into the web.

Thus, it is an object of the present invention to provide an improved anodizing method and apparatus.

It is a further object of the present invention to provide an anodizing system capable of producing a better anodized coating on one side of a metal web.

It is a further object of the present invention to provide an anodizing system including a contact cell and an anodizing cell and a novel arrangement of anodes and cathodes for producing a thicker, more even anodized coating on one side of the metal web.

It is a further object of the present invention to provide an improved method and apparatus for producing lithographic plates.

It is a further object of the invention to provide an anodizing system including a cold water sealing bath.

DETAILED DESCRIPTION

Figures 1, 2, 3, 4, 5:
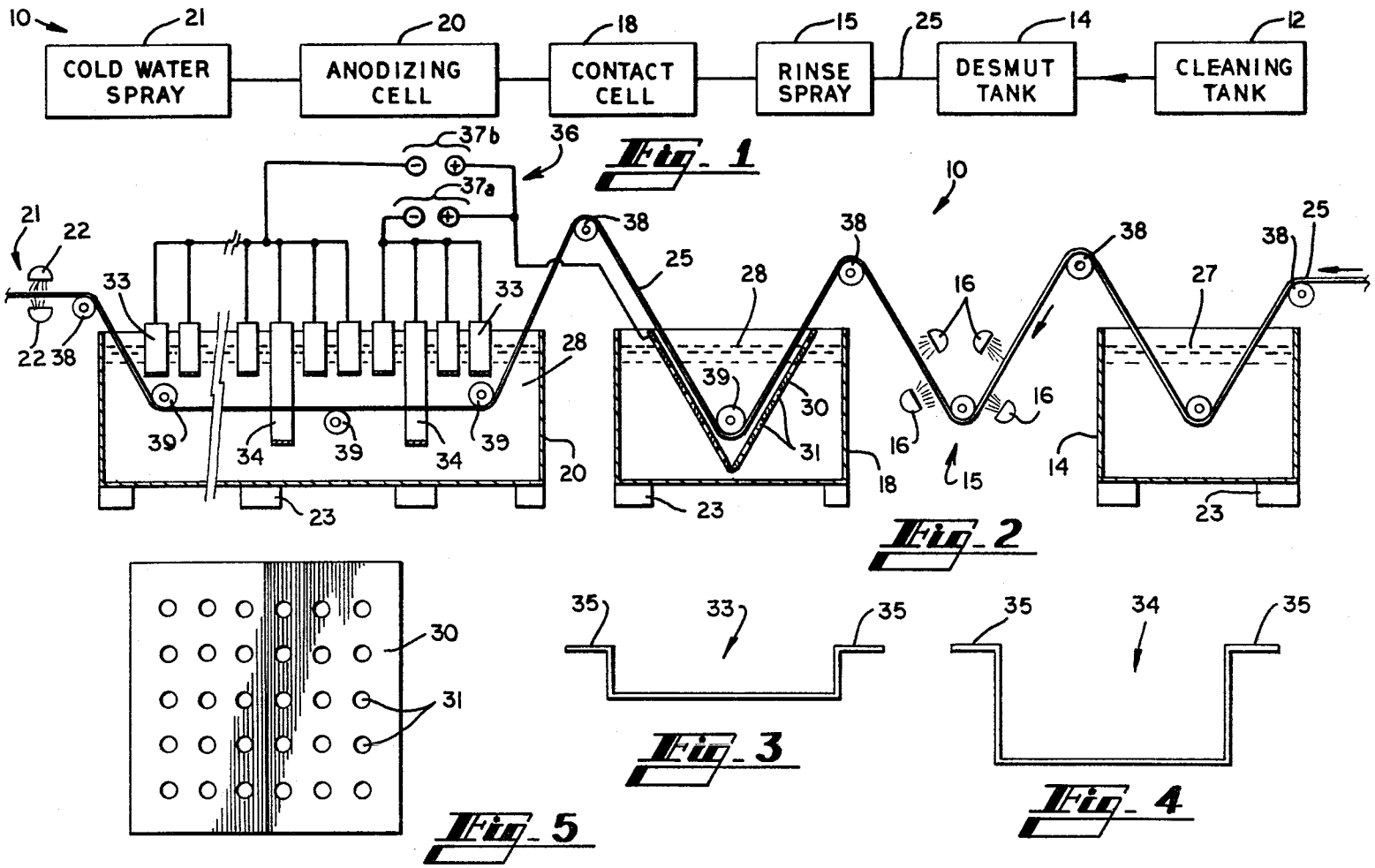
FIG. 1 is a schematic block diagram of an anodizing system embodying the present invention.
FIG. 2 is a vertical cross sectional view of a portion of the anodizing system shown in FIG. 1.
FIG. 3 is an end view of an upper cathode utilized in the anodizing system shown in FIG. 2.
FIG. 4 is an end view of a lower cathode utilized in the anodizing system shown in FIG. 2.
FIG. 5 is an end view of the perforated anode utilized in the anodizing system shown in FIG. 2.

Referring now in more detail to the drawing, in which like numerals represent like parts throughout the several views, FIG. 1 is a diagramatic block diagram of an anodizing line 10 embodying the present invention. An aluminum web 25 is taken from a continuous roll (not shown) and delivered sequentially into the various treatment elements of the anodizing line 10 from right to left in FIG. 1. As the web travels through the system, it first passes through a cleaning tank 12, then a de-smut tank 14, and then a rinse spray station 15, all of which perform functions in a manner known to those skilled in the art. Thereafter, the web passes into a contact cell 18 wherein the web is positively charged, then into an anodizing cell 20 wherein the web is coated with aluminum oxide, and finally to a cold water spray station 21 where the coating is sealed.

Referring to FIG. 2, the de-smut tank 14, rinse spray station 15, contact cell 18, anodizing cell 20 and cold water spray station 21 are shown in vertical cross section. The aluminum web 25 is guided through the various tanks, cells and spray stations by a plurality of guide rollers 38 and 39. Some of the guide rollers 39 are submerged within electrolyte in the cells and therefore comprise polyvinylchloride or some other substance that is not deteriorated by the chemicals within the cells. A de-smut tank 14, contact cell 18, and anodizing cell 20, as shown in FIG. 2, are mounted on insulating supports 23 which can be, for example, railroad cross ties. The contact cell 18 and anodizing cell 20 contain an electrolyte 28, preferably, sulphuric acid, and therefore are constructed of steel plate sealed with a plastic material that is non-reactive with the sulphuric acid.

Suspended in the electrolyte 28 contained in the contact cell 18 is a V-shaped anode 30 which extends across the contact cell to completely underly the web 25. The arms of the "V" are formed by electrical grade aluminum plates as shown in FIGS. 2 and 5. The anode 30 includes holes or perforations 31 at regular intervals to allow the electrolyte 28 to circulate within the contact cell 18. The aluminum anode 30 is provided with a coating of chemical lead so that the anode 30 will not react with the sulphuric acid electrolyte 28 and deteriorate. The use of an electrical grade aluminum core for the anode 30 provides greater conductivity than would be provided by an anode constructed completely of chemical lead.

The anodizing cell 20 includes a plurality of cathodes including upper cathodes 33 and lower cathodes 34. The shape of the cathodes 33 and 34 is shown in FIGS. 3 and 4, respectively. Each cathode 34, 35 is a U-shaped bar of lead-jacketed aluminum having horizontal support arms 35 extending from each upper side of the "U" to support the cathode from the side walls of the anodizing cell 20, and a central horizontal portion at the bottom of the "U". The upper electrodes 33 extend a short distance down into the electrolyte 28 in the anodizing tank 20, whereas the lower electrodes 34 extend a further distance toward the bottom of the anodizing cell 20. The guide rollers 39 in the anodizing tank 20 are arranged to direct the aluminum web 25 beneath the upper cathodes 33 and through the U-shaped passage defined by the lower cathodes 34, the preferred path being midway between the depth of the central horizontal portion of the upper and lower cathodes.

It will be noted in FIG. 2 that considerably more upper cathodes are provided in the anodization cell 20 than lower cathodes, to enable a larger current density to flow between the aluminum web 25 and the upper cathodes 33 than is driven between the web and the lower cathodes 34.

A direct current power supply 36, shown diagramatically in FIG. 2, is connected at its positive output to the anode 30 and at its negative output to each of the cathodes 33 and 34. The power supply 36 preferably comprises two rectifiers, the first rectifier 37*a* directing about one-third of the total current to an initial group of the cathodes 33 and 34, and the second recitifer 37*b* directing about two-thirds of the current to the remaining cathodes nearer to the exit end of the anodizing cell 20. This differentiation of current density along the anodizing tank 20 compensates for the fact that the anodized coating being built up on the aluminum web 25 reduces the conductivity of the web 25, and therefore a greater current is required in order to efficiently add further coating to the web 25 in the latter portion of the anodizing cell 20.

The rinse spray section 15 includes a plurality of water spray heads 16 arranged to direct a spray of water on both the top and bottom surfaces of the aluminum web 25. The spray heads 16 are connected by supply lines (not shown) to the water supply of the building in which the system is located. Similarly, the cold water spray section 21 includes a plurality of spray heads 22 which are arranged to thoroughly cover the top and bottom surfaces of the web 25 with cold water from the building water supply.

In the operation of the anodization line 10, the aluminum web 25 is drawn from right to left in FIG. 2 along a path defined by the guide rolls 38 and 39. The web 25 is caused to dip into the cleaning tank 12 and then the desmut tank 14 in preparation for anodization. After passing under the spray heads 16 of the rinse spray section 15, the web 25 enters the electroltyte 28 in the contact cell 18. The web 25 is guided in a V-shaped path parallel to the upper surface of the V-shaped anode 30. The power supply 36 causes the anode 30 to be positively charged, thereby drawing electrons from the web 25 and leaving the bottom surface of the web 25 positively charged. It is believed that the web 25 retains a differential positive charge on the bottom surface on the web because of the relatively low conductivity of the aluminum used in manufacturing lithographic plates. Commonly used, "lithograde" aluminum alloys have conductivity ranging from 37–58% (by volume) of the International Annealed Copper Standard (IACS). Conductivity values for selected grades of aluminum are shown in the following table:

| Aluminum Alloy | Conductivity (% IACS by volume) |
|---|---|
| 1100-0 | 58% |
| 1100-H18 | 57% |
| 1100-H24 | 37% |
| 1100-H26 | 37% |
| 3003-0 | 50% |
| 3003-H14 | 41% |
| 3003-H18 | 40% |

The web 25 thus leaves the contact cell 18 with a positive charge evenly distributed across the bottom surface of the web 25, the charge being evenly distributed because the web has passed the anode 30 in a path parallel to the surface of the anode 30. As the web 25 enters the anodizing cell 20, it passes between the upper cathodes 33 and the lower cathodes 34. Current flows between the negatively charged cathodes and the positively charged web. Since most of the cathodes are located above the web 25, the current density will be predominately into the upper surface of the web 35. Since the positive charge is predominantly on the lower surface of the web 25, the negative ions that are attracted to the top surface of the web 25 to form the anodized coating are attracted by the positive charge on the lower surface of the web 25 and are therefore caused to penetrate deeply into the irregularities in the top surface of the web 25. The lower electrodes 34 cause a light coating to be anodized onto the bottom surface of the web 25. After exiting the anodizing cell 20, the web 25 is sprayed on both its top and bottom surfaces with a cold water spray from the spray heads 22 to seal the anodized coating.

The result of the above-described process is that a heavy, even, deeply penetrating anodized coating is placed on the upper surface of the web 25, the upper surface then being used as the working surface of lithographic plates cut from the aluminum web 25. Lithographic plates manufactured in accordance with the present invention have produced in excess of 25% more impressions when used on a lithographic printing press than the number of impressions generally expected from a lithographic plate manufactured by a conventional anodization process using the same current density.

EXAMPLE

A thirty two inch wide web of 1100-H26 No. 2 lithograde aluminum was anodized in an anodizing line embodying the present invention at 20 feet per minute. The thickness of the web was 0.008 inches. The anodizing cell was 30 feet in length and had mounted therein 15 upper cathodes and 6 lower cathodes. The current density supplied to the anodizing cell was 17 amperes per square foot, the total current therefore being 1360 amperes, with about one-third (460 amperes) being delivered to an initial group of cathodes and the remaining current (900 amperes) being delivered to the remaining cathodes. An improved anodized plate for lithographic printing was obtained, the aluminum having a heavy, very evenly anodized coating on the upper surface thereof. A light coating was deposited on the bottom surface.

It will thus be seen that the particular differentiation of positive charge on the aluminum web in the contact cell and controlled current flow in the anodizing cell caused by the arrangement of the anode and cathodes as described above produce a novel and unexpected result in the form of an improved lithographic plate.

While this invention has been described in detail with particular reference to a preferred embodiment thereof, it will be understood that variations and modifications can be affected within the spirit and scope of the invention as described herein before and as defined in the appended claims.

I claim:

1. A method of anodizing a metal web comprising the steps of:

drawing said web through a contact cell containing an electrolyte therein while placing a positive charge predominantly on a first surface of said web;

subsequently drawing said web through an anodizing cell containing said electrolyte while passing a direct current predominantly between a second surface of said web and a cathode within said anodizing cell adjacent to said second surface of said web.

2. The method of claim 1 wherein said metal comprises aluminum having a conductivity less than 60%, and said electrolyte comprises sulphuric acid.

3. In an apparatus for anodizing a metal web, including a contact cell containing an electrolyte and an anodizing cell containing said electrolyte, the improvement comprising:

anode means mounted within said contact cell so as to extend parallel to the path of said web and adjacent to a first side of said web for placing a positive charge predominantly on said first side of said web; and cathode means mounted within said anodizing cell adjacent a second side of said web opposite to said first side of said web for passing a direct current predominantly between said cathode means and said second side of said web.

4. The apparatus of claim 3 further comprising a cold water spray means for spraying cold water onto said web when said web emerges from said anodizing cell.

5. The apparatus of claim 3 wherein said cathode comprises a plurality of cathodic electrodes, a portion of said cathodic electrodes carrying the preponderance of current flowing between said cathodes and said web being located adjacent said second surface of said web.

6. The apparatus of claim 3 wherein said anode comprises a perforated aluminum sheet coated with lead.

7. The apparatus of claim 6 further comprising a guide roller within said contact cell for guiding said web in the path of a "V" in said contact cell, and wherein said anode is formed in the shape of a "V".

8. The apparatus of claim 3 wherein said metal comprises aluminum having a conductivity less than 60%.

* * * * *